US009182155B2

(12) United States Patent
Crumlin et al.

(10) Patent No.: US 9,182,155 B2
(45) Date of Patent: Nov. 10, 2015

(54) ENVIRONMENTALLY ADAPTABLE TRANSPORT DEVICE

(76) Inventors: Ethan J. Crumlin, Worchester, MA (US); Geoff Becker, Philadelphia, PA (US); Shauna Jin, Cambridge, MA (US); Amy Lai Wong, Brooklyn, NY (US); Nathan Barker Ball, Cambridge, MA (US); Gabriel Nestor Sanchez, Stanford, CA (US); Daniel George Walker, Cambridge, MA (US); Christopher Paul Possinger, Boston, MA (US); Olumuyiwa Oni, Boston, MA (US); Emily Smith, Canton, MI (US); Kabir Mukaddam, Boston, MA (US); Myraida A. Vega Gonzalez, Timonium, MD (US)

( * ) Notice: Subject to any disclaimer, the term of this patent is extended or adjusted under 35 U.S.C. 154(b) by 1249 days.

(21) Appl. No.: 12/277,204

(22) Filed: Nov. 24, 2008

(65) Prior Publication Data

US 2009/0139248 A1 Jun. 4, 2009

Related U.S. Application Data

(63) Continuation-in-part of application No. 11/296,681, filed on Dec. 7, 2005, now abandoned.

(60) Provisional application No. 60/634,419, filed on Dec. 8, 2004.

(51) Int. Cl.
*F25B 9/14* (2006.01)

(52) U.S. Cl.
CPC ..... *F25B 9/14* (2013.01)

(58) Field of Classification Search
CPC ..... F25B 21/00; F25B 9/02
USPC ..... 62/3.7, 130, 371, 457.2, 457.7, 372, 3, 62/6

See application file for complete search history.

(56) References Cited

U.S. PATENT DOCUMENTS

| | | | | |
|---|---|---|---|---|
| 2,702,458 | A * | 2/1955 | Del Mar | 62/59 |
| 3,664,144 | A * | 5/1972 | Sarbacher | 62/3.62 |
| 4,364,234 | A * | 12/1982 | Reed | 62/3.3 |
| 4,771,900 | A * | 9/1988 | Leoncavallo et al. | 211/84 |
| 5,927,078 | A * | 7/1999 | Watanabe et al. | 62/3.6 |
| 6,418,729 | B1 * | 7/2002 | Dominguez-Alonso et al. | 62/3.6 |
| 6,422,030 | B1 * | 7/2002 | Calvert | 62/314 |
| 6,519,948 | B2 * | 2/2003 | Zorn | 62/3.6 |
| 6,550,651 | B1 * | 4/2003 | Murdoch et al. | 224/153 |
| 6,698,210 | B2 * | 3/2004 | Ogura et al. | 62/6 |
| 6,769,268 | B2 * | 8/2004 | Gano, III | 62/457.2 |
| 7,367,749 | B2 * | 5/2008 | Kim | 405/186 |
| 2001/0039802 | A1 * | 11/2001 | Barrash | 62/6 |
| 2002/0005043 | A1 * | 1/2002 | Rudick et al. | 62/6 |
| 2003/0126882 | A1 * | 7/2003 | Hunter | 62/457.2 |
| 2005/0208845 | A1 * | 9/2005 | Jansen | 440/27 |

* cited by examiner

*Primary Examiner* — Mohammad M Ali
*Assistant Examiner* — Emmanuel Duke

(57) ABSTRACT

Disclosed is a device for the transport of temperature sensitive products including an insulated container, an insulated lid, a fastener to secure the lid to the container, an active heat exchanger, a thermal circuit to circulate heat exchange, a temperature sensor read by a temperature regulating circuit that maintains a temperature range, a power source, and a support frame that arranges the elements of the device with the overall center of mass at a location adapted for transport and storage of the device. Disclosed is also a method of transport for temperature sensitive products including securing the temperature sensitive product within an insulated container with a lid, removing heat from the container to maintain a temperature range, strapping the device onto the user's back and adjusting to the shape of the user, freeing both hands during transport of the device, and minimizing hindrances to user mobility caused by the device.

23 Claims, 5 Drawing Sheets

ENVIRONMENTALLY ADAPTABLE TRANSPORT DEVICE

CROSS-REFERENCE TO RELATED APPLICATIONS

This application is a continuation of prior application Ser. No. 11/296,681, filed 7 Dec. 2005, which is incorporated in its entirety by this reference.

This application claims the benefit of U.S. Provisional Application No. 60/634,419, filed 8 Dec. 2004, which is incorporated in its entirety by this reference.

TECHNICAL FIELD

This invention relates generally to the field of temperature regulating devices, and more specifically to a new and useful portable temperature regulating device in the field of transport of temperature sensitive products.

BACKGROUND

There are many often life dependent situations in which a product or substance must be kept under a strict temperature range for a given amount of time, yet may need to travel to areas that do not have an established power grid or availability of a large, consistent power supply. In many areas of society, there is a pressing need for such a method of transporting various objects or substances over long distances and time spans, while maintaining the substances at constant temperature or within various temperature ranges. For example, the organs, vaccines, medicine, and food benefit greatly from reliable means of temperature regulation during transport. For instance, the World Health Organization states that 4.3 million deaths occur each year due to vaccine preventable diseases and that many of these deaths could be averted if cold chain (i.e., the intricate system for vaccine transport, delivery, and administration) technologies for keeping vaccines above their freeze-sensitive range and below their heat-sensitive range were more efficient. First response disaster relief may also benefit from reliable and portable means for temperature regulated medicine transport.

The current mode of vaccine transport involves packing vaccines with phase-change materials such as conventional/dry ice, which are then carried by foot, horse, motorbike, etc. from cities to rural medical outreach centers. Since vaccines must be kept within a strict temperature range of 2-8° C. (36-46° F.) and may no longer be viable if the temperature deviates outside this range, this presents a great problem as strict temperature control is extremely difficult to maintain during the final destination journeys from the cities to the rural areas and account for 75-80% of all vaccine wastage alone. In addition, phase-change materials such as ice have freezing and melting temperatures that do not match the desired temperature range suitable for the vaccines, thus placing vaccines at the risk of wastage even when the heat absorption properties of the phase-change material is still viable. The passive nature of such phase-change materials also leaves certain regions of the vaccine carrier to have lower temperature than others, resulting in uneven cooling. Moreover, since the tendency is to bring more vaccines than are needed in an area, once the cooling source evaporates or expires, the excess vaccines also go to waste.

There are a number of transport systems in existence for maintaining consistent temperature controls. However, these known systems fail to meet the highly specific requirements for transporting sensitive substances, such as vaccines. Generally, two main issues present these failures. The first failure being sufficient temperature regulation of the environment in which these substances are transported. Most environmental control devices or "cold carriers" currently utilized are simply coolers using ice packs. The adaptability to varying environments and substances in terms of temperature regulation using these cold carriers is quite limited in flexibility of temperature. The second failure is transportability. The prior art includes refrigerated transport units, which can control the temperature of their internal environments. However, most of these are not designed for single or multiple person portability. Rather, these known refrigerated transport units generally require a powerful consistent and accessible power supply, which is typically not available in many areas of the world.

Thus, there is a need in the field of transportation of temperature sensitive products to create a new and useful environmentally adaptable device to overcome the disadvantages and drawbacks of the prior art. There is also a need for a transport device able to adapt to varying environments and products requirements in terms of temperature regulation and temperature consistency over time. Additionally, there is a need for a transport device that offers adaptable transportability and power requirements for the control of internal temperature and environment, while being designed (e.g., both compact and ergonomically designed) for single or multiple person portability. This invention provides such a new and useful device.

DESCRIPTION OF THE PREFERRED EMBODIMENTS

Figure 1:
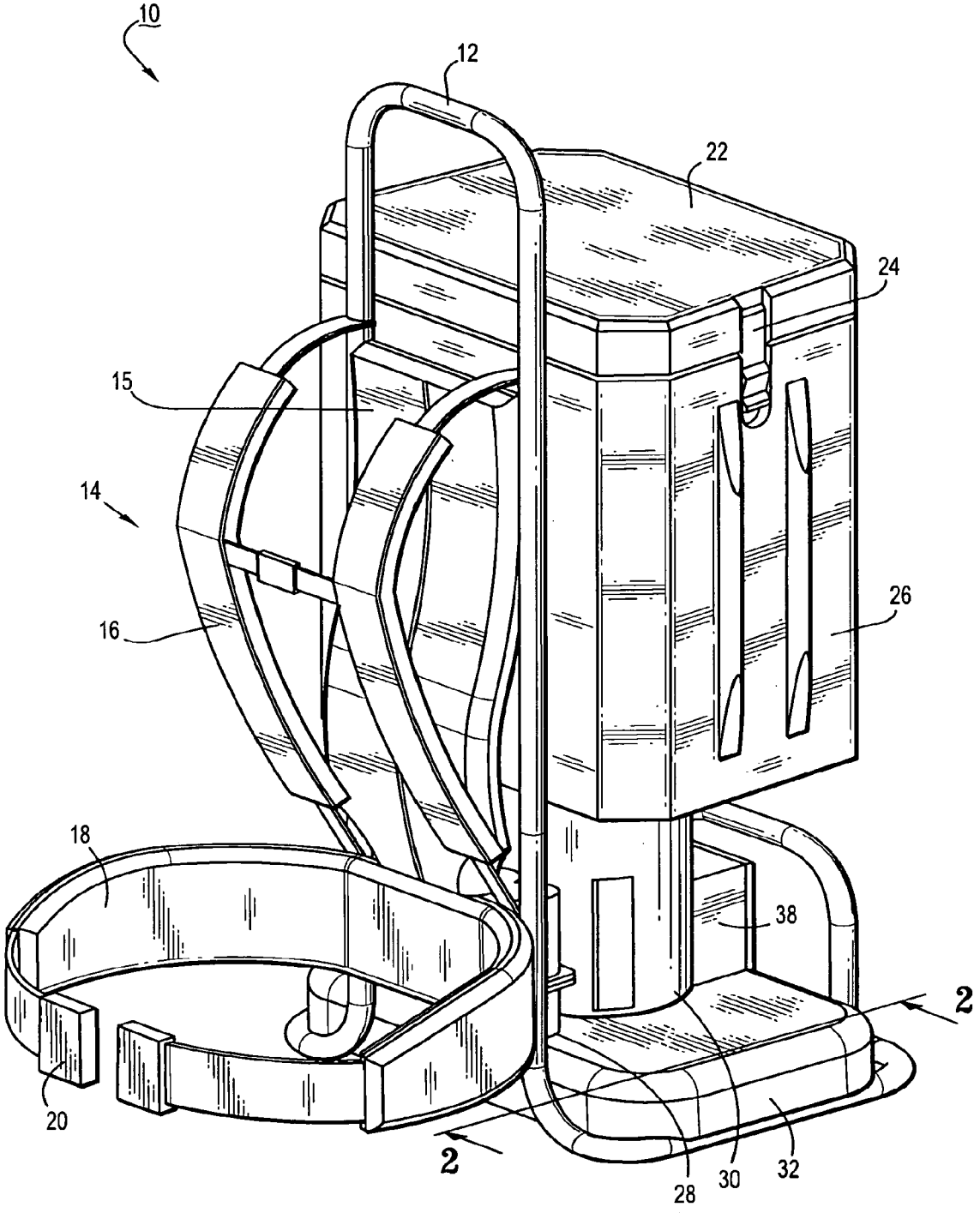
FIG. 1 is a perspective view of the environmentally adaptable transport device according to the present disclosure.

The following description of the preferred embodiments of the invention is not intended to limit the invention to these preferred embodiments, but rather to enable any person skilled in the art to make and use this invention.

The exemplary embodiments of the environmentally adaptable transport device and methods of use disclosed are discussed in terms of temperature control and transport devices for accomplishing environmentally controlled transport of, for example, products and substances used in the medical field. The environmentally adaptable transport device may also employ the temperature controlled transport of foodstuffs and additional consumer based demands, such as, the storage of foodstuffs at desired temperatures for various time periods. Such a need is evidenced, for example, by fisherman in remote areas of the world that do not have a power grid, so a conventional refrigerator is not useful, but must often times keep their catches at similar temperatures to the temperature of the water the fish came from in order to keep the fish from premature spoiling. It is envisioned that the principles relating to refrigeration and temperature controls disclosed herein include employment with various methods and techniques for temperature control, such as, for example, gas expansion, thermal-electric, and mechanical refrigeration methods, as well as efficient temperature control methods, such as, for example, insulation materials that provide increased R-factors that allow higher and longer lasting temperature gradients.

In the discussion that follows, the term "temperature sensitive products" or "products" will refer to a variety of substances including, for example, vaccines, slides, organs, tissue and body parts, medicine, other medical/biological substances, animals, foodstuffs and the like, that require either a consistent temperature or temperature range for the preservation of such substances.

The environmentally adaptable transport device according to the present disclosure offers temperature regulation, portability and adaptability to varying and sometimes hostile environments. The transport device may utilize a variety of methods for obtaining power and can use that power to control the temperature within its structure. The control of temperature may be loosely or tightly controlled dependent upon requirements of the associated transport products. The transport device may utilize a variety of transport modes, such as, for example, carrying by a person (via backpack straps, a shoulder strap, etc.), being pulled on a handcart, sled or skis or transported on a vehicle.

The following discussion includes a description of the environmentally adaptable transport device in accordance with the principles of the present disclosure. Alternate embodiments are also disclosed. Reference will now be made in detail to the exemplary embodiments of the present disclosure, which are illustrated in the accompanying figures. Turning now to the figures wherein like components are designated by like reference numerals throughout the several views and initially to FIGS. 1 and 2, there is illustrated an environmentally adaptable transport device, such as, for example, a transport device 10, in accordance with the principles of the present disclosure.

The components of transport device 10 are fabricated from materials suitable for environmental transport applications, such as, for example, polymerics, carbon fiber or metals, such as titanium, stainless steel, depending on the particular application and intended use and environment of the transport device. Semi-rigid and rigid polymerics are contemplated for fabrication, as well as resilient materials, such as molded grade polyurethane, silicone, etc. The sealing components (e.g., gaskets, edges and interior components of the container 26) of the transport device 10 may be fabricated from materials such as elastomers and the like. One skilled in the art, however, will realize that other materials and fabrication methods suitable for assembly and manufacture, in accordance with the present disclosure, also would be appropriate.

Figure 2:
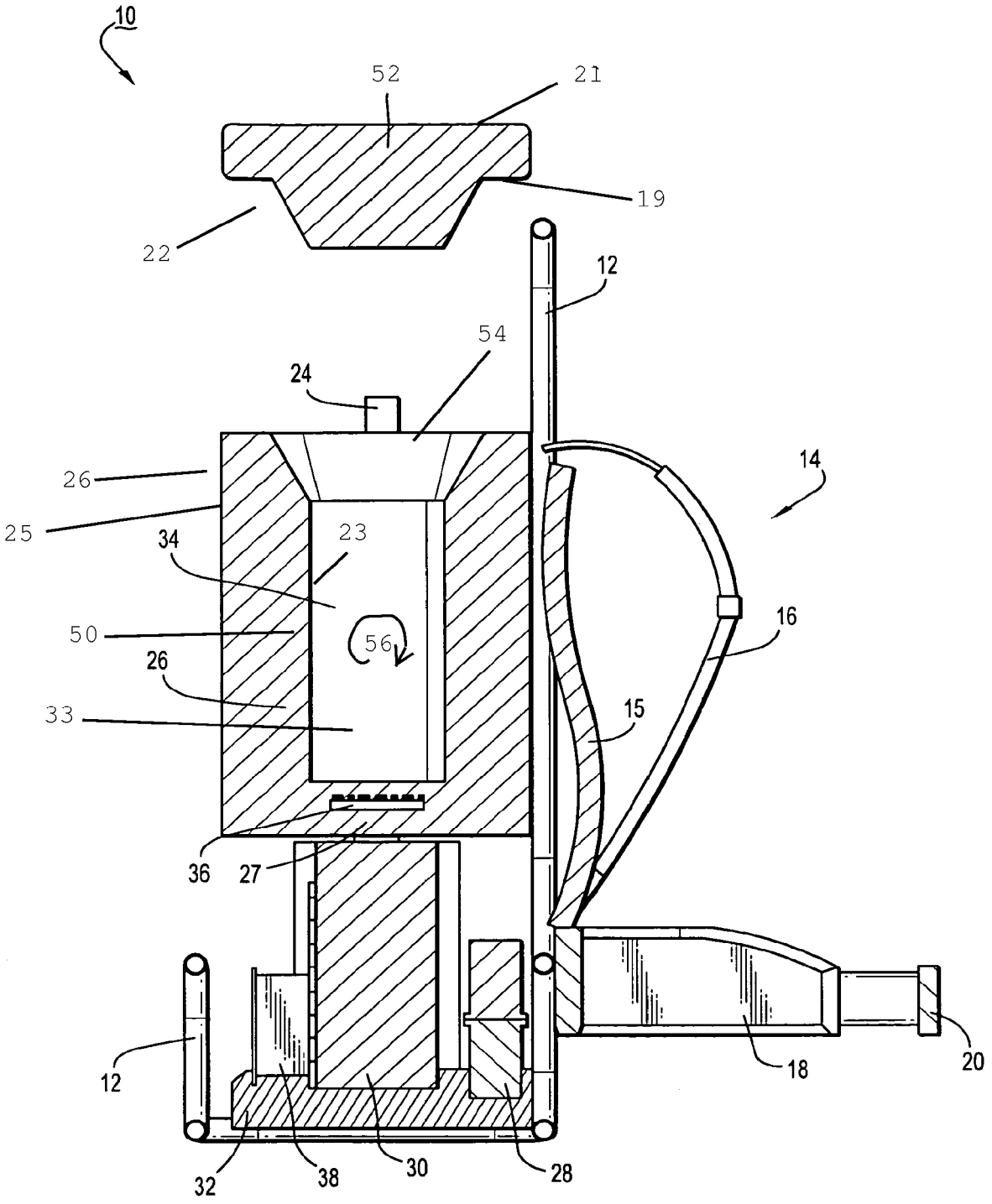
FIG. 2 is cross-sectional view along line 2-2 of the environmentally adaptable transport device shown in FIG. 1.

As shown in FIGS. 1 and 2, the environmentally adaptable transport device 10 is reusable in an environmentally controlled transport application such as, for example, the transport of vaccines to areas where temperatures and terrains are less than hospitable and/or the storage of vaccines in regions where refrigeration is not available. The transport device is designed to be lightweight and designed to weigh less than 150 lbs., preferably less than 50 lbs., and more preferably less than 35 lbs. Therefore, the transport device 10 can be employed for multiple uses and locations throughout the world. The adaptable transport device 10 includes a container 26 that defines a cavity 34 and includes an inner container wall 23, outer container wall 25, container insulation 50 that is placed between the inner container wall 23 and outer container wall 25, and an opening 54 that allows access to the cavity 34; a lid 22 that seals the opening 54 and includes an inner lid wall 19, an outer lid wall 21, and lid insulation that is placed between the inner lid wall 19 and the outer lid wall 21; a fastener 24 to secure the lid to the container; an active heat exchanger 38; a thermal circuit 56; a temperature sensor 33; a temperature regulating circuit 38; a power source 28; and a support frame 12.

The elements of the transport device 10 work in tandem to provide a portable, self-contained, strict temperature controlled transport and storage unit. For example, in the preferred embodiment, the transport device 10 may be used to transport or store vials 42 of a temperature sensitive product such as vaccines in areas where electrical power grids are scarce. Because grid power is scarce, the device preferably has low power consumption and a long cold life (or, length of time in which the desired temperature range is maintained within the cavity 34) when the device is not connected to a power providing grid. When used to transport vaccines to difficult to reach areas during vaccine outreach programs, the transport device 10 preferably carries a supply of vaccines enough to serve the people of the desired outreach region in order to minimize the number of trips necessary and time spent on vaccine transport. In this variation of the preferred embodiment, the container 26 and lid 22 are preferably both insulated with relatively high insulation values (R) and the cavity 34 of the container 26 preferably holds approximately 1,200 doses of standard liquid vaccines within vials 42, but may alternatively hold any other number of doses. The temperature regulating circuit 38 of this variation of the preferred embodiment utilizes the temperature sensor 33 and functions to maintain a 2-8° C. (36-46° F.) temperature range. Heat exchange within the cavity 34 is provided by the heat exchanger 30. The thermal circuit 56 preferably heat exchange throughout the cavity 34. The power source 28 preferably provides power to the heat exchanger 30, the temperature regulating circuit 38, and the thermal circuit 56. The frame 12 preferably secures and supports the elements of the transport device 10 in an arrangement with the overall center of mass in a location in relation to the center of volume that functions to ease the transport and/or use of the transport device 10. Other variations of the preferred embodiment include use as a low power refrigerator to store temperature sensitive products in regions where medical supplies are scarce and/or refrigeration is not readily available.

The container 26 functions to define a cavity 34 that holds temperature sensitive products with an opening 54 to allow for access to the cavity 34. The container is preferably of a shape similar to a rectangular prism shape to facilitate manufacturing and arrangement onto the frame 12, but may alternatively be of a shape similar to a cylindrical shape, which may decrease the rate at which heat enters the container 26. The overall surface area of a cylinder is less than that of a rectangular prism, thus minimizing the area through which heat transfer may occur. However, any other suitable shape may be used. The container is preferably of a color that minimizes heat absorption, such as a light color. In some regions where the transport device 10 may be used, certain colors may have certain cultural implications, for example, black may suggest death, and thus, the color of the container is preferably of a color culturally acceptable for the intended purpose of the transport device 10. The cavity 34 of the container 26 is preferably shaped to accommodate the temperature sensitive product to be transported and/or stored by the transport device 10, for example, organs, vaccines, medicine, chemicals, passive thermal packs, and/or food. Because colder air sinks relative to warmer air, the opening 54 is preferably located at the top of the cavity 34 such that when the cavity 34 is exposed, the colder air contained within will less likely to come into contact with the warmer air of the ambient environment, minimizing heat exchange. Alternatively, the opening 54 may be on the side or bottom of the cavity 34 to facilitate access to the temperature sensitive products contained within. The outer container wall 25 defines the outer shape of the container and the inner container wall 23 defines the shape of the cavity 34. The inner container wall 23 and the outer container wall 25 define a space in which container insulation 50 is placed. The inner container wall 23 and the outer container wall 25 are preferably individually manufactured and then assembled with container insulation 50 to create the container 26. The inner container wall 23 and the outer container wall 25 are preferably injection molded, but may alternatively be vacuum formed, thermoformed, or manufactured using any other suitable method. Alternatively, the inner container wall 23 and the outer container wall 25 may be manufactured together with an opening for the container insulation 50. The combined inner and outer container wall 23, 25 may be formed using injection molding, blow molding, thermoforming, or any other suitable manufacturing process. In this variation, the container 26 may also include a wall cap that functions to seal the opening used to assemble the container insulation 50 in between the inner container wall 23 and outer container wall 25. Alternatively, the assembly opening may be adequately small or appropriately located to allow the container insulation 50 to remain secure and supported in between the inner container wall 23 and outer container wall 25 without a wall cap. The inner and outer container walls 23, 25 may also include features that facilitate the assembly and/or better secures the container insulation 50 in between two walls 23 and 25, such as ridges or protrusion patterns that extend into the insulation cavity.

The container insulation 50 is preferably of a relatively high insulation value (R) to allow the container 26 to maintain the desired temperature range within cavity 34 for as long as possible. The container insulation 50 is preferably high insulation foam, but may alternatively be BLO-foam, Styrofoam, vacuum insulation panels, heat reflectors, and/or any other suitable insulation material or combination of insulation materials.

The container 26 may also include passive thermal packs that function to prolong the cold life of the transport device 10. Passive thermal packs are heat exchangers that are not capable of actively removing heat but rather have had heat removed prior to use (for example, through refrigeration in a freezer) and heat is then reabsorbed during use until thermal equilibrium is reached. Passive thermal packs may be ice packs or phase change materials designed to remain within a certain temperature range. By including passive thermal packs within the container 26, the desired temperature range within the cavity 34 may be maintained for a longer period after the active heat exchanger 30 is no longer conducting heat exchange in the event power is no longer available.

The cavity 34 of the container 26 may also include additional elements to accommodate for the desired temperature sensitive product to be transported or stored. For example, in the case of organ transport, the container may include organ sustaining elements such as fluid irrigation, waterproof chambers, etc. In the variation of the preferred embodiment shown in FIG. 3, the transport device 10 is used to transport and store vials of temperature sensitive product. To secure, support, and efficiently utilize space within the cavity 34, the cavity 34 includes racks 40 designed to secure and support a plurality of vials 42 containing, for example, vaccine or other medicine can be stored within the cavity. The vial racks 40, internal structures or other receiving means may be made of a lightweight material such as, for example, aluminum or plastic. In this variation, the cavity 34 preferably includes rails 35 that function to define spaces into which the racks 40 slide into and function to secure the racks 40 in the space. The rails 35 also preferably function to secure passive thermal packs that may be placed within cavity 34 that function to prolong the cold life of the transport device 10. Alternatively, the cavity 34 may include compartments, shelves and/or other elements to secure the vial racks 40. It is contemplated that other suitable means of securing various contents within the cavity 34 may be formed such as shelving, pouches, fluid solutions, nesting of additional storage compartments and the like.

The lid 22 functions to seal the opening 54. The lid 22 preferably is of a shape that complements the shape of the container 26 to allow for a secure seal between the lid 22 and the container 36. For example, the interface between the lid 22 and the container 26 is preferably a flat surface to minimize gaps in the interface and prevent heat exchange. The interface between the lid 22 and the container 26 may include gaskets, o-rings, or any other sealant material suitable to provide a relatively airtight seal. The lid 22 is preferably fully detachable from the container 26, but may alternatively be hinged to the container 26 on one side and opened using a swinging motion. The lid 22 may also be of a sliding type and assembled onto lid rails on the container 26 and slid to one side when access to the opening 54 is desired. However, the lid 22 may be of any other type of lid suitable to seal the container 26. The lid 22 includes an inner lid wall 19 that faces the cavity 34 and an outer lid wall 21 that faces the ambient environment that define a space in which lid insulation 52 is placed. Similar to the inner and outer container wall 23, 25, the inner and outer lid wall 19, 21 are preferably individually manufactured and then assembled with lid insulation 52 to create the lid 22. The lid 22 is preferably injection molded, but may alternatively be vacuum formed, thermoformed, or manufactured using any other suitable method. Again, similar to the inner and outer container walls 23, 25, the inner and outer lid walls 19, 21 may be manufactured together with an opening for the lid insulation 52 and may include a wall cap to seal the assembly opening through which the lid insulation 52 is placed into the space in between the two walls. The assembly opening may alternatively be adequately small or appropriately located to allow the lid insulation 52 to remain secure and supported without a wall cap. The inner and outer lid walls 19, 21 may also include features that facilitate the assembly or better secures the container insulation 50 in between two walls 19 and 21 such as ridges or protrusion patterns that extend into the insulation cavity.

The lid insulation 52 is preferably of similar or identical properties and materials as the container insulation 50 mentioned above.

Figure 3:
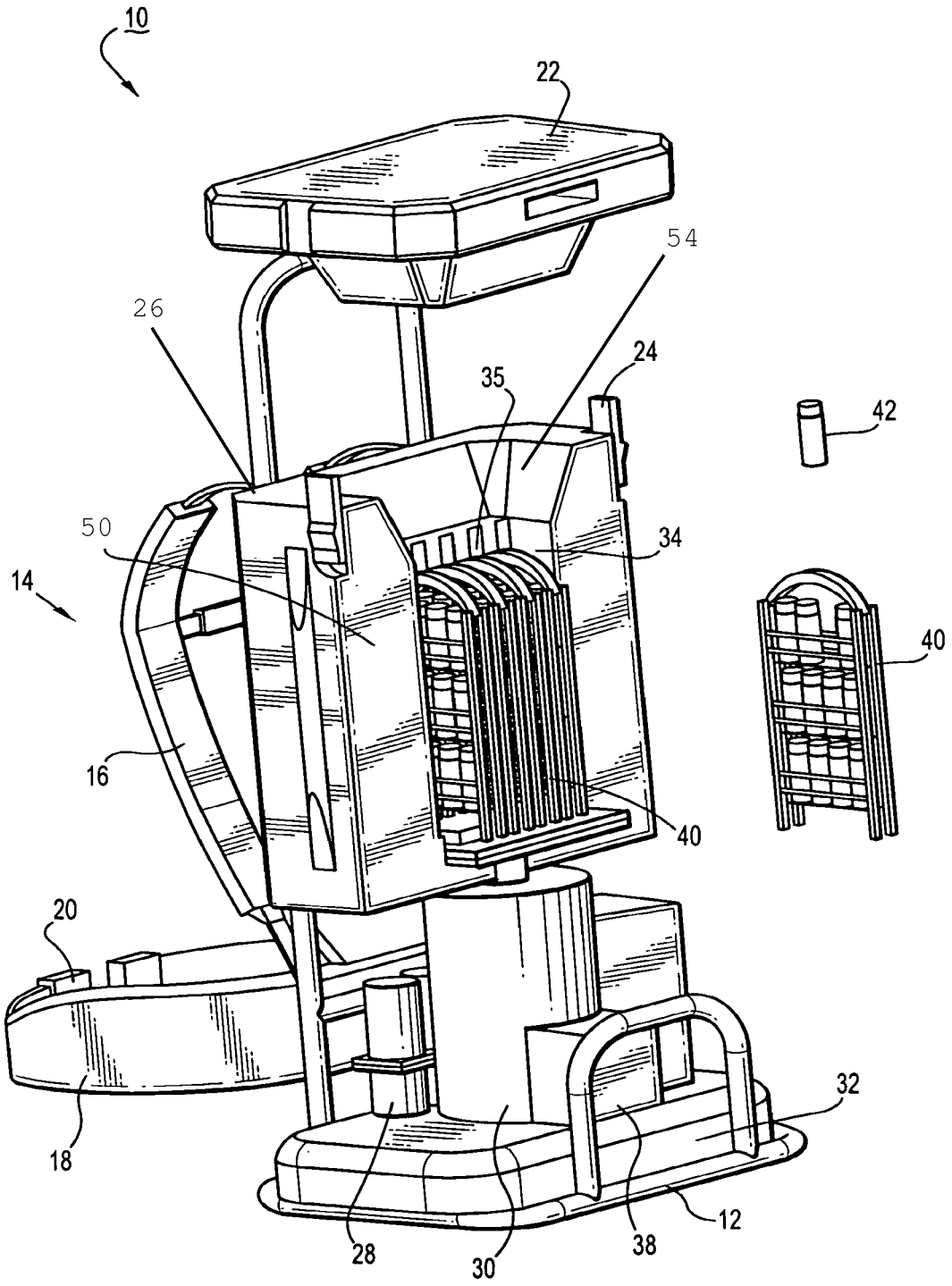
FIG. 3 is a partial exploded view of the environmentally adaptable transport device shown in FIG. 1.

The fastener 24 functions to secure the lid 22 onto the container 26. In one variation of the preferred embodiment as shown in FIGS. 2 and 3, the inner container wall 23 includes a taper at the opening 54 where the opening 54 starts at the dimensions of the cavity 34 and expands as it the top of the container 26. The inner lid wall 19 includes a reciprocating taper that fits into the tapered opening formed by the inner container wall 23 when the lid 22 is assembled onto the container 26. The fastener 24 of this variation is of the compressive type, such as a lever lock attached to the container 26 that engages a protrusion on the lid 22 and pulls the lid 22 toward the container 26, compressing the tapered surfaces together and forming a tight seal. This type of lock utilizes the resistance of the tapered surfaces to compression and remains locked until a user disengages the locking mechanism. The fastener 24 may alternatively be threads on the lid 22 with reciprocating threads on the container 26, screws, adhesive, buttons, clasps, hook and loop fasteners, friction, gravity, suction, cams, sliding, and/or latches. However, the fastener 24 may be any other locking mechanism suitable to secure the lid 22 to the container 26, whether the lid 22 is fully removable, hinged, sliding, or any other type of lid.

The active heat exchanger 30 functions to remove heat from the cavity 34 and may include a typical refrigerant compression device that is known in the art. Preferably such devices are compact, lightweight and highly efficient. It is also contemplated that the active heat exchanger 30 may utilize a variety of refrigerant gasses and fluids, peltier and/or thermo-electric devices, Stirling cooler technologies, resistors, forms of conduction, forms of natural/forced convection by convection fans 37, forms of radiation and the like. The active heat exchanger 30 of the preferred embodiment is preferably an electrically powered Stirling cooler. The active heat exchanger 30 is preferably a commercially available Stirling cooler that is capable of providing the desired temperature range, is light, and efficient. An example of such a Stirling cooler is the Free Piston Stirling Cooler manufactured and sold by Twinbird Corporation in Niigata Prefecture Japan. A Stirling cooler utilizes the Stirling cycle (a relatively efficient thermal cycle) and is relatively lightweight. The active heat exchanger 30 may alternatively be a thermo-electric cooler, such as a peltier cooler, which contains little to no moving parts, is small, lightweight, and benefits from using electrical power sources. However, any other heat exchanger suitable to provide the desired temperature range within cavity 34 may be used.

The active heat exchanger 30 preferably has a distinct cold end and a distinct hot end. This is true for most cooling devices, including Stirling and peltier coolers, which run on their respective thermal cycles that remove heat from one medium to another (for example, from the container 26 to the ambient environment). In the preferred embodiment, the cold end of the heat exchanger 30 is preferably assembled to the heat exchanger interface 27 of the cavity 34. The heat exchanger interface 27 is preferably at the bottom of the cavity 34 while the opening 54 is preferably at the top of the cavity 34, thus utilizing the property of cold air to sink to prevent the cold air from escaping the cavity 34. The heat exchanger interface 27 preferably accommodates for the cold end of the active heat exchanger 30 but is otherwise insulated and sealed from the ambient environment to minimize cold loss. The heat exchanger interface 27 may alternatively be in any other location in relation to the cavity 34.

The transport device 10 may also include heat exchange facilitator 36 that is preferably mounted onto the cold end of the active heat exchanger 30 that functions to provide a larger surface area for heat exchange to take place. The heat exchange facilitator 36 is preferably made of aluminum and is shaped with multiple fins to maximize dissipation, but may alternatively be any other thermally conductive material, shape or method such as ducts, heatsinks, fins, conduction, radiation, mass transport, etc.

Figure 4:
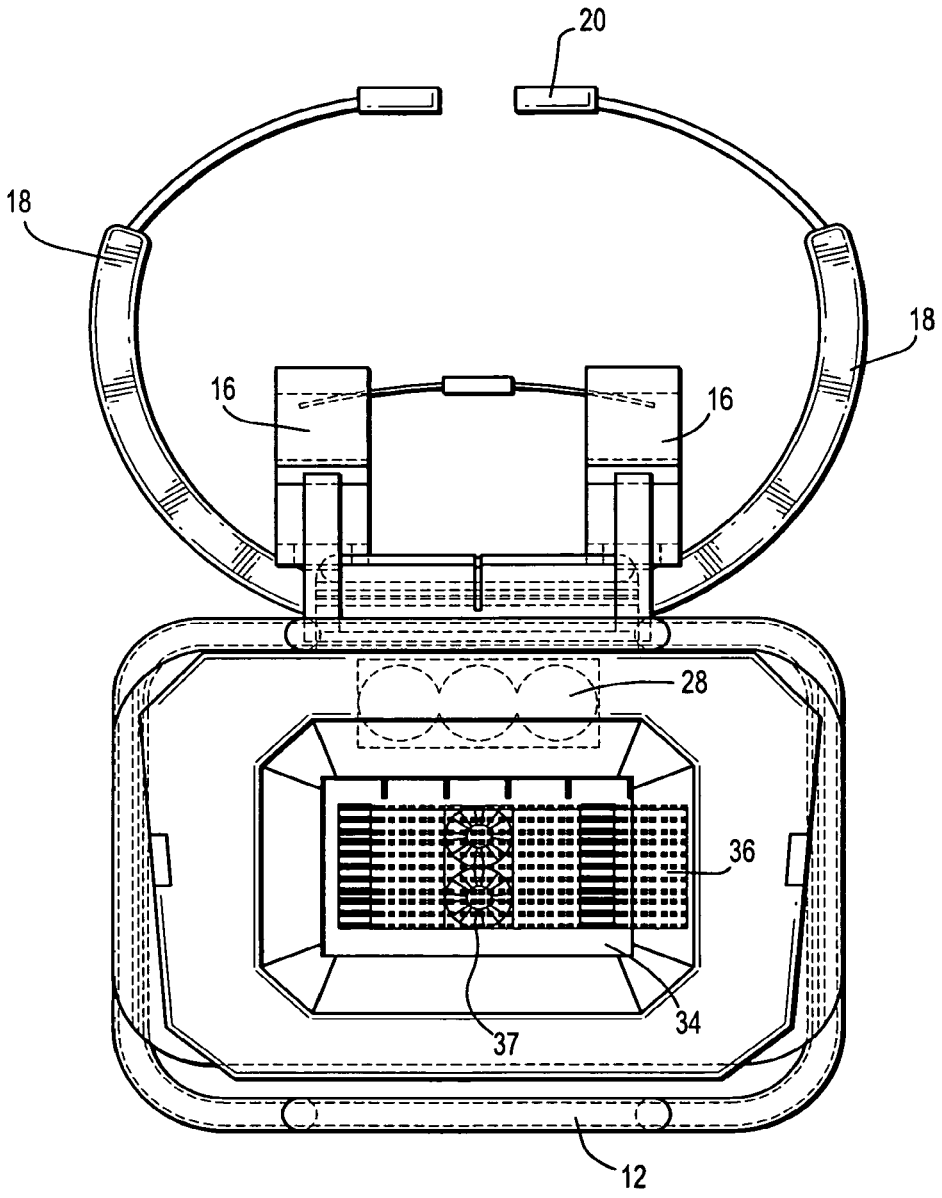
FIG. 4 is a top plan view in partial cross-section of the environmentally adaptable transport device shown in FIG. 1.
Figure 5:
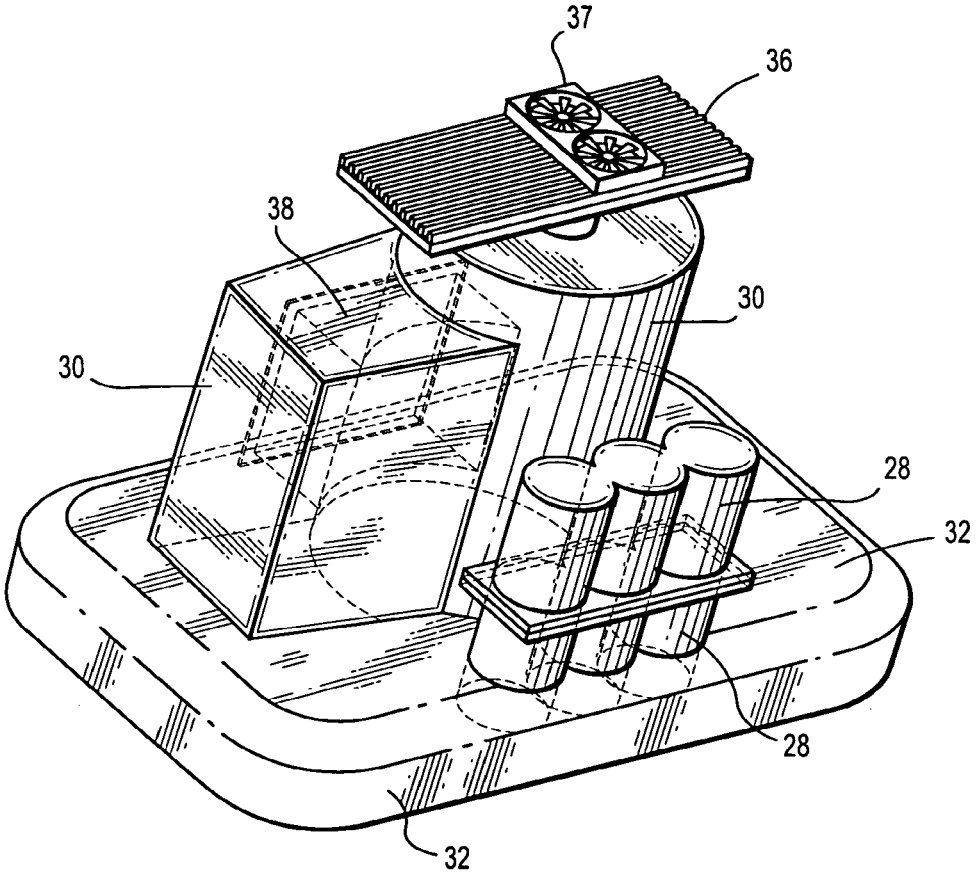
FIG. 5 is a partial exploded phantom view of a power supply and temperature regulating device of the environmentally adaptable transport device shown in FIG. 1.

The thermal circuit 56 functions to carry the heat exchange generated by the active heat exchanger 30 through to the entire cavity 34. In the preferred embodiment, the cold end of the active heat exchanger 30 is assembled into the active heat exchanger interface 27 located in the bottom of the cavity 34. Heat exchange is carried out in proximity to the heat exchanger 30. Because of the tendency for cold air to sink, it is necessary for the thermal circuit 56 to circulate the cold air to the upper portions of the cavity 34 to allow heat exchange to occur in other areas of the cavity 34. As shown in FIGS. 4 and 5, the thermal circuit 56 preferably includes fans 37 that are assembled into the heat exchange facilitator 36 and function to force air across the surface of the heat exchange facilitator 36 and create a convection current that carries the cold air through to the entire cavity 34. The fans 37 preferably blow upwards to counteract the tendency for cold air to sink. To prevent the fans 37 from blowing the cold air through the opening 54 when the lid 22 is removed, the fans 37 are preferably linked to a control circuit that senses the removal of lid 22 and subsequently turns off the fans 37. It is contemplated that alternative configurations of the thermal circuit 56 may be used to accomplish thermal heat exchange between the active heat exchanger 30 and the cavity 34. For example, thermal pipes, heat displacement via cooling fins, thermal siphons, phase change, conduction, radiation, mass transport, etc. may be used to create the thermal circuit 56.

The temperature sensor 33 of the preferred embodiment preferably includes a plurality of temperature sensors placed at the bottom, middle, and top of cavity 34. This allows for the temperature at various regions of the cavity 34 to be detected and facilitates more accurate temperature regulation. The temperature sensors are preferably of the resistive type (for example, a thermistor) but may alternatively be a of the thermocouple type. However, any other suitable type of temperature sensor maybe used.

The temperature regulating circuit 38 functions to control the thermal circuit 56 and the active heat exchanger 30 to maintain the desired temperature range within the cavity 34. The temperature regulating circuit 38 is preferably of a feedback type wherein temperature readings are gathered from the temperature sensor 33 and then evaluated for the appropriate action from the thermal circuit 56 and active heat exchanger 30. Temperature readings of the resulting temperature within cavity 34 are then taken to determine the next appropriate action. The temperature regulating circuit 38 preferably regulates the temperature within cavity 34 such that lowest reading from the temperature sensors 33 is not below the lower value of the desired temperature range and the highest reading from the temperature sensors 33 is not above the higher value of the desired temperature range. Alternatively, the temperature within cavity 34 may be regulated such that the average of the temperature sensors 33 is maintained within the desired temperature range. Once the temperature of the cavity 34 is above the desired temperature range, the temperature regulating circuit 38 preferably turns on the active heat exchanger 30 to extract heat from within the cavity 34. Once the temperature of the cavity 34 is below the desired temperature range, the temperature regulating circuit 38 preferably turns off the active heat exchanger 30. This type or regulation functions to minimize the power used to maintain the desired temperature range within cavity 34. As mentioned above, the temperature regulating circuit 38 may also function to sense the removal of lid 22 and subsequently stop the thermal circuit 56 to prevent excess heat exchange with the ambient environment. The temperature regulating circuit 38 may also function to control other aspects of the transport device 10, for example, the start and stop of heat exchange operations. The temperature regulating circuit 38 may also include a memory adapted to store historical data of the transport device 10, for example, GPS reading location data storage, historical temperature data storage, etc. Additionally, the temperature regulating circuit 38 may control other temperature parameters, such as the desired temperature setting and temperature logging.

The temperature regulating circuit 38 may also include a temperature indicator that functions to inform the user of the temperature conditions within the cavity 34. The temperature indicator is preferably a visual indication of the internal temperature, but may alternatively be audible or tactile or any other suitable user notification method. For example, an alarm may go off whenever the temperature within the cavity 34 is no longer within the desired temperature range, or, the user may strap onto a bodypart a remote that vibrates whenever the temperature within the cavity 34 is no longer within the desired temperature range. The temperature indicator may also indicate other system information of the transport device 10 such as power levels or other control parameters.

The power source 28 functions to power the active heat exchanger 30, the thermal circuit 56, and the temperature regulating circuit 38. The power source 28 also functions to power any other functions that require power in the transport device 10. The power source 28 is preferably of a rechargeable battery such as a lead acid battery, lithium ion battery, nickel metal hydride battery, NiCad battery, etc. Alternatively, the power source 28 may be fuel cells or any other power source suitable to power the transport device 10. The power source 28 is preferably recharged using a connection to an AC/DC outlet, but may alternatively utilize solar panels, a motor (vehicle engine or other type of motor), wind power, hydro-power, or human power (such as foot or hand power). For example, charging using wind power, hydro-power, or human power may be accomplished by allowing wind, water, or human to rotate a motor and generating electricity. The power source 28 may alternatively be real time power source type in which power that is necessary is collected and used, for example, as a user travels with the transport device 10, solar panels may be used to collect power to instantly power the device, or, as the user travels with the transport device 10, power harnessed from motion (ie, from human movement, from vibrations of the transport device 10, etc) may be collected to instantly power the device. However, any other source of power suitable to recharge the power source 28 may be used. The power source 28 preferably contains and/or supplies enough power necessary to sustain sufficient and consistent temperature within the cavity 34 (ie, maintain cold life of the transport device 10) given the insulation of the container 26 and lid 22 for at least 24 hours while disconnected from external power charging sources in the desired application environment. Cold life of the transport device 10 may also be extended using passive thermal packs such as phase change materials, thermal mass and the like that may be placed within the cavity 34.

The frame 12 functions to secure and support the elements of the transport device 10 in an arrangement with the overall center of mass in a desired location in relation to the center of volume while providing the transport device 10 with a means to stand stably without external support. Additionally, in applications such as vaccine transport, outreach organizations such as the World Health Organization require vaccine carries to be able to sustain a drop from 1 meter without allowing irreparable damage to the products held inside. The frame 12 functions to provide this functionality to the transport device 10. In addition to providing rigidity and support for the elements of transport device 10, the frame 12 also functions to provide a means to carry and transport the transport device 10. In the preferred embodiment, the transport device 10 is a highly portable transport and storage device meant for use in difficult to reach outreach regions. For this reason, the frame 12 is preferably designed to be carried on the user's back as a backpack to allow both hands of the user to remain free and includes a backpack attachment 14 including backpack support 15, strap members 16, harness 18 and locking buckle 20. It is contemplated that other types of carrying frames 12 and backpack attachments 14 may be utilized as is known in the art. The desired center of mass of a backpack relative to the center of volume is determined based upon ergonomic studies and is preferably positioned as close to the center of mass of the user (approximately between the shoulder blades and below the mid torso) as possible. For example, in the arrangement shown in FIGS. 1-3, the overall center of mass is preferably positioned lower than the center of the volume in the vertical direction and closer to the backpack support 15 than the center of volume in the horizontal direction. The backpack attachment 14 preferably functions not only to provide a method of carrying the transport device 10, but also to provide comfort and ease in carrying the transport device 10. The shape, size, amount of padding, and/or arrangement of the elements in the backpack attachment 14 preferably function in tandem with the shape, center of mass, and/or center of volume of the elements of the transport device 10 to provide an ergonomic carrying experience for the user. For example, given the location of the center of mass relative to the user's body, the backpack support 15, straps 16, and harness 18 are preferably shaped and padded such that areas of a high concentration of weight on the user's body are formed to minimize discomfort and pain. The frame 12 may alternatively include wheels, be positioned on a type of dolly, be attached to a sled or skis, and/or include handles for carrying by one or more persons or even animals to achieve the portability for the preferred application. The frame 12 may alternatively hold the center of mass of the transport device 10 much lower than the center of volume to allow the transport device 10 to be better suited to stand without external support in long term storage applications. However, any other center of mass to center of volume relationship suitable for the desired uses of the transport device 10 may be used.

As shown in FIG. 2, for greater support and protection, the frame 12 generally surrounds the main body portion of the transport device 10. The carrying frame 12 may be formed with any suitable material such as aluminum, carbon fiber, or any other material suitably light and sturdy, and is preferably relatively light yet sturdy in order to facilitate the transportation of relatively large amounts of cargo (e.g., vaccines) over relatively far distances in a variety of environments.

The frame 12 further includes a bottom or base portion 32 that generally provides support for the active heat exchanger 30, power source 28 and temperature regulating circuit 38. The base portion 12 may also provide shock protection to the transport device 10 and especially to the active heat exchanger 30. The shock protection component of the base portion 32 may be formed from known suitable materials that act to dampen impacts from being dropped, crushed and the like.

As a person skilled in the art will recognize from the previous detailed description and from the figures and claims, modifications and changes can be made to the preferred embodiments of the invention without departing from the scope of this invention defined in the following claims.

We claim:

1. A method of transport of temperature sensitive products with a cold transport device comprising the steps of:

providing a support frame including straps adapted to be strapped to a single human, providing an insulated container with a proximal half and a distal half opposite the proximal end half and defining a cavity that receives temperature sensitive products;

coupling the proximal half of the insulated container to the support frame;

thermally coupling a Stirling cycle type heat exchanger to the container and the cavity of the container;

removing heat from the cavity of the container and expelling it to the ambient environment;

monitoring the temperature within the cavity with a temperature sensor;

regulating the operation of the Stirling cycle type heat exchanger to control the temperature within the cavity;

providing a portable power source to power the Stirling cycle type heat exchanger arranging the support frame, the insulated container, the Stirling type heat exchanger, and the portable power source such that the overall center of mass of the cold transport device is within the proximal half of the insulated container;

limiting the capacity of the cavity for receiving temperature sensitive products to substantially maintain the overall weight of the cold transport device to a weight suitable for carry by a single human.

2. The method of claim 1, wherein the step of limiting the capacity of the cavity includes the step of limiting the capacity of the cavity for receiving temperature sensitive products to substantially maintain the overall weight of the cold transport device to be equal to or less than 35 pounds.

3. The method of claim 1, wherein the step of arranging the support frame, the insulated container, the Stirling cycle type heat exchanger, and the portable power source such that the overall center of mass of the cold transport device is within the proximal half of the insulated container includes the steps of thermally coupling the Stirling cycle type heat exchanger to the bottom of the container and to the interior of the cavity and arranging the center of mass of the portable power source underneath the proximal half of the container.

4. The device of claim 1, further comprising the step of arranging the temperature sensitive products within the cavity of the container to maintain the overall center of mass of the cold transport device within the proximal half of the insulated container.

5. The method of claim 4, wherein the step arranging the temperature sensitive products within the cavity of the container to maintain the overall center of mass of the cold transport device within the proximal half of the container includes the step of holding a volume of temperature sensitive product substantially fixed within frames and including rails within the cavity of the container to receive and arrange the frames within the cavity.

6. The method of claim 1, wherein the step of providing an insulated container with a proximal half and a distal half opposite the proximal end half and defining a cavity that receives temperature sensitive products includes providing an insulated container that is taller than it is wide.

7. The method of claim 4, arranging the temperature sensitive products within the cavity of the container to maintain the overall center of mass of the cold transport device within the proximal half of the insulated container includes the step of arranging the temperature sensitive products substantially in the center of the container.

8. A device for cold transport comprising:

A plurality of frames that are each adapted to hold a volume of temperature sensitive product in a substantially fixed location within the frame;

A support frame including a top portion and a bottom portion opposite the top portion and including straps that are to be strapped to a single human;

A container including a top end and a bottom end opposite the top end and including an inner container surface that defines and arranges a cavity that includes rails and a capacity adapted to receive the plurality of frames, an outer container surface, container insulation placed between the inner and outer container surfaces, and an opening in the top end that allows access to the cavity, wherein the container includes a proximal half adjacent to and coupled to the support frame and a distal half opposite the proximal half;

A lid adapted to seal the opening in the container including an inner lid surface, an outer lid surface, and lid insulation placed between the inner and outer lid surfaces;

A fastener to secure the lid to the container;

A Stirling cycle type heat exchanger with a first end substantially rigidly coupled to the bottom end of the container and the cavity of the container and a second end substantially opposite the first end that is flexibly coupled to the support frame;

A temperature sensor that detects the temperature in at least one portion of the cavity;

A temperature regulator that communicates with the temperature sensor and the active heat exchanger to regulate the Stirling cycle type heat exchanger to substantially maintain a certain temperature range within the cavity;

A portable power source coupled to the support frame and positioned substantially underneath the proximal half of the container that provides power to the temperature sensor, the regulator, and the Stirling cycle type heat exchanger;

Wherein the support frame supports and secures the container, the lid, the fastener, the Stirling cycle type heat exchanger, and the portable power source in an arrangement with the overall center of mass located substantially within the proximal half of the container;

Wherein the capacity and arrangement of the cavity within the container receives and arranges the frames of temperature sensitive product to substantially maintain the overall center of mass within the proximal half of the container and wherein the number of frames received by the capacity of the cavity substantially maintains the overall weight of the device to a weight suitable for carry by a single human; and Wherein the capacity of the portable power supply, the efficiency of the Stirling cycle type heat exchanger, the container insulation, and the lid insulation cooperate to remove heat from within the cavity and substantially maintain the internal temperature of the cavity within a certain temperature range for a round trip vaccine outreach session.

9. A device for cold transport comprising: a support frame; a container that includes container insulation and defines a cavity with a capacity adapted to receive a cargo and an opening that allows access to the cavity, wherein the container includes a proximal half adjacent to and coupled to the support frame and a distal half opposite the proximal half; a lid that includes lid insulation; a fastener to secure the lid to the container; a Stirling cycle type heat exchanger thermally coupled to the cavity of the container and arranged to the support frame underneath the container; a portable power source coupled to the support frame and positioned such that the center of mass of the portable power source is arranged underneath the proximal half of the container; wherein the support frame supports and secures the container, the lid, the fastener, the Stirling cycle type heat exchanger, and the portable power source in an arrangement with the overall center of mass located substantially within the proximal half of the container; wherein the container further includes an inner container surface that defines and arranges the cavity and an outer container surface, wherein the container insulation is placed between the inner and outer container surfaces of the container.

10. The device of claim 9, wherein the container insulation is placed between the inner and outer container surfaces of the container, and wherein the thickness of the container insulation between the inner container surface and the outer container surface at the proximal half of the container is substantially equal to the container insulation thickness between the inner container surface and the outer container surface at the distal half of the container.

11. The device of claim 9, wherein the capacity and arrangement of the cavity within the container receives and arranges the cargo to substantially maintain the overall center of mass of the device within the proximal half of the container.

12. The device of claim 11, wherein the capacity and arrangement of the cavity further receives and arranges the cargo to substantially maintain the overall weight to be less than or equal to 35 pounds.

13. The device of claim 9, further comprising a temperature sensor that detects the temperature within the cavity in at least one section of the cavity.

14. The device of claim 13, further comprising a controller that communicates with the temperature sensor and the active heat exchanger to regulate the active heat exchanger to substantially maintain a certain temperature range within the cavity.

15. The device of claim 9, wherein the cavity further includes removable racks that support and secure vials and include a handle that is handled by the user to insert and extract the racks from the cavity.

16. The device of claim 15, wherein the cavity further includes a set of rails adapted to receive the racks.

17. The device of claim 16, wherein the rails are further adapted to receive passive thermal packs.

18. The device of claim 9, wherein the cavity defined by the container is taller than it is wide.

19. The device of claim 9, wherein the container further includes an inner container surface that defines and arranges the cavity and an outer container surface, wherein the inner surface of the container includes a taper at the opening wherein the opening starts with the dimensions of the cavity and expands to be larger at the interface with the outer container surface, wherein the lid includes a taper adapted to mate with the taper of the inner surface of the container, and wherein the fasteners are of a compression type adapted to pull the lid towards the container and to compress the tapers of the lid and the container to each other.

20. The device of claim 9, wherein the container insulation and the lid insulation are selected from the group consisting of vacuum insulation panels, insulating foam, and heat reflectors.

21. The device of claim 9, further comprising a heat exchange facilitator that increases the rate at which heat is removed from the cavity by increasing the surface area for heat exchange.

22. The device of claim 9, further comprising fans that create a convection current for heat exchange throughout the cavity by forcing air across the heat exchange facilitator and to the cavity.

23. The device of claim 9, wherein Stirling cycle type heat exchanger includes a first end and a second end opposite the first end, wherein the first end is substantially rigidly coupled to the container and the second end is substantially flexibly coupled to the support frame.

* * * * *